US007794207B2

(12) United States Patent
Bacciottini

(10) Patent No.: US 7,794,207 B2
(45) Date of Patent: Sep. 14, 2010

(54) DISK OF A DISK ROTOR FOR A GAS TURBINE

(75) Inventor: Carlo Bacciottini, Siena (IT)

(73) Assignee: Nuovo Pignone Holding S.p.A., Florence (IT)

( * ) Notice: Subject to any disclaimer, the term of this patent is extended or adjusted under 35 U.S.C. 154(b) by 912 days.

(21) Appl. No.: 10/596,922

(22) PCT Filed: Dec. 22, 2004

(86) PCT No.: PCT/EP2004/014774

§ 371 (c)(1),
(2), (4) Date: Jun. 29, 2006

(87) PCT Pub. No.: WO2005/064120

PCT Pub. Date: Jul. 14, 2005

(65) Prior Publication Data

US 2009/0016888 A1 Jan. 15, 2009

(30) Foreign Application Priority Data

Dec. 29, 2003 (IT) ..... MI03A002607

(51) Int. Cl.
*F01D 5/02* (2006.01)

(52) U.S. Cl. ..... 416/219 R

(58) Field of Classification Search ..... 416/204 R, 416/219 R, 198 A; 415/199.5
See application file for complete search history.

(56) References Cited

U.S. PATENT DOCUMENTS

| | | | | |
|---|---|---|---|---|
| 4,471,008 | A * | 9/1984 | Huther | 427/383.5 |
| 5,054,996 | A | 10/1991 | Carreno et al. | |
| 5,522,706 | A * | 6/1996 | Mannava et al. | 416/215 |
| 6,094,905 | A | 8/2000 | Fukuyama et al. | |
| 6,106,233 | A * | 8/2000 | Walker et al. | 416/213 R |
| 2002/0124570 | A1 | 9/2002 | Akiyama et al. | |

FOREIGN PATENT DOCUMENTS

| | | | |
|---|---|---|---|
| JP | 57193701 | A | 11/1982 |
| JP | 58140406 | A | 8/1983 |
| JP | 2-43401 | U | 3/1990 |

* cited by examiner

*Primary Examiner*—Edward Look
*Assistant Examiner*—Jesse Prager
(74) *Attorney, Agent, or Firm*—Potomac Patent Group PLLC

(57) ABSTRACT

Disk of a disk rotor for a gas turbine comprising a central portion (22), an intermediate portion (24), an outer portion (28), a series of axial pass-through holes (27) for a series of tie rods and a series of slots (50) for housing a corresponding series of vanes, the central portion (22) comprises a central axial pass-through hole (23), a first collar (30) situated at a first end and a second collar (40) situated at a second end of the central portion (22).

The series of holes (27) is positioned in the outer portion (28) of the disk so as to obtain high dynamic characteristics of the rotor and at the same time a sufficient useful life thereof.

20 Claims, 3 Drawing Sheets

DISK OF A DISK ROTOR FOR A GAS TURBINE

The present invention relates to a disk of a disk rotor for a gas turbine, in particular a disk of a disk rotor for an axial compressor of a gas turbine.

The rotodynamic stability of disk rotors used in modern gas turbines requires structures with strict limits on the flexural and torsional inertia characteristics.

One of the difficulties in the engineering is to reconcile the request for high dynamic characteristics, in particular flexural and torsional inertia, with that for a strong structure capable of resisting high fatigue stress cycles.

The reason for this is that rotors are made up of a series of disks axially constrained by means of a series of tie rods which are inserted in a series of holes far from the maximum stress areas to avoid subjecting their structure to stress.

These areas are represented by the outer shaped portion in which there are a series of slots for housing a respective series of vanes which vigorously shake the structure of each disk.

An objective of the present invention is to provide a disk of a disk rotor for a gas turbine which allows high dynamic characteristics of the disk rotor, such as flexural and torsional inertia, and at the same time is strong and stable so as to enable a sufficient useful life of the disk rotor itself.

A further objective is to provide a disk of a disk rotor for a gas turbine which allows high safety levels and at the same time a sufficient useful life of the disk rotor itself.

Another objective is to provide a disk of a disk rotor for a gas turbine which has a reduced stress concentration level.

Yet another objective is to provide a disk of a disk rotor for a gas turbine which is strong and reliable.

These objectives according to the present invention are achieved by providing a disk rotor for a gas turbine as indicated in claim 1.

Further characteristics of the invention are specified in the subsequent claims.

The characteristics and advantages of a disk of a disk rotor for a gas turbine according to the present invention will appear more evident from the following illustrative and non-limiting description, referring to the enclosed schematic drawings, in which.

Figure 1:
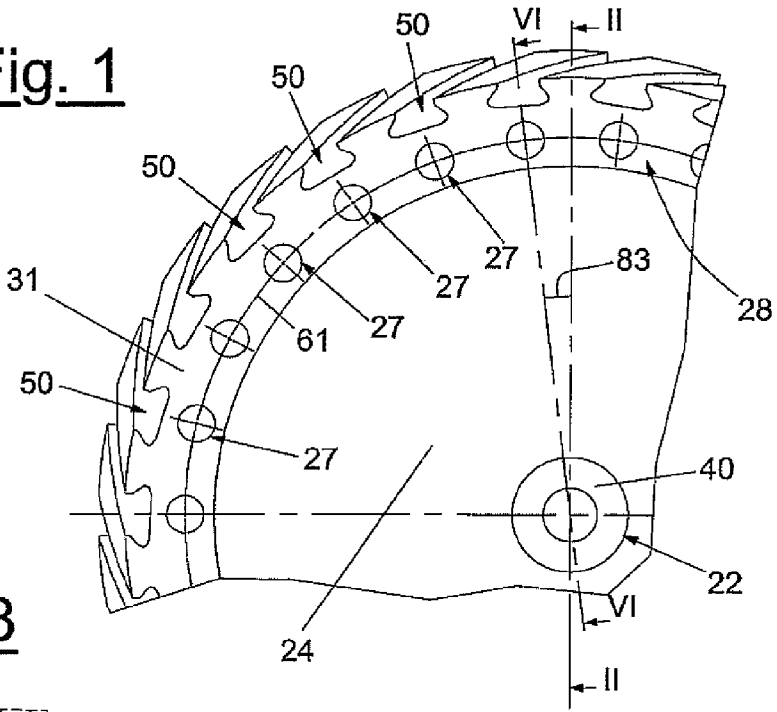
FIG. 1 is a raised right side view of a preferred embodiment of a disk of a series of disks of a disk rotor according to the present invention.
Figure 3:
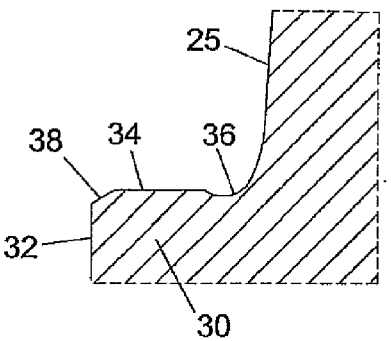
FIG. 3 is a detail of FIG. 2.
Figure 2:
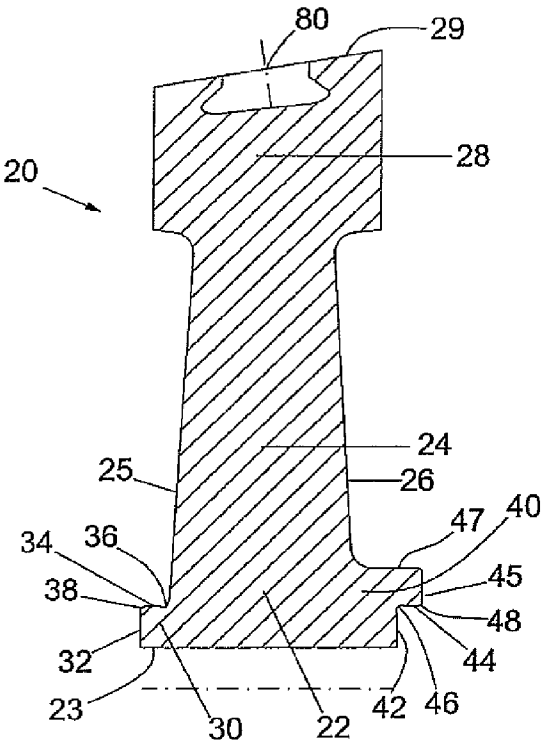
FIG. 2 is a sectional view of FIG. 1 according to the line II-II.
Figure 4:
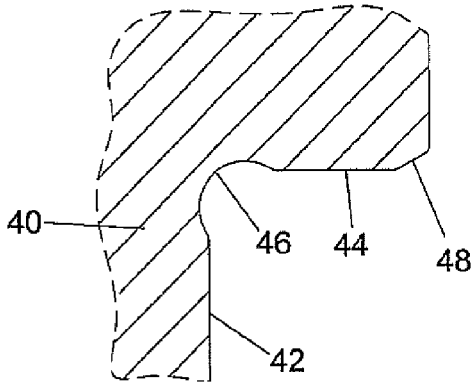
FIG. 4 is a detail of FIG. 2.
Figure 5:
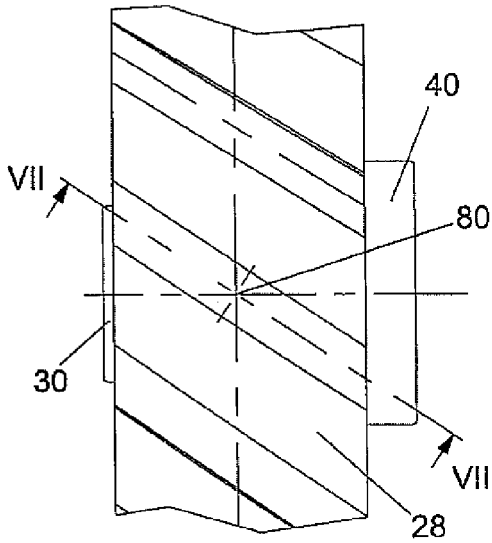
FIG. 5 is a view from above of the disk of FIG. 1.
Figure 6:
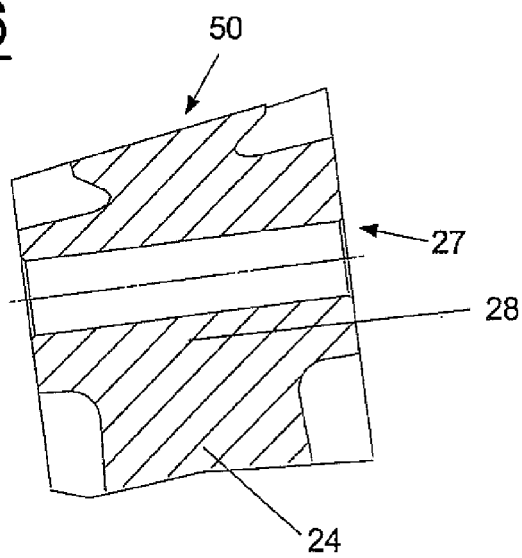
FIG. 6 is a sectional view of FIG. 1 according to the line VI-VI.

With reference to the figures, these show a disk 20 of a disk rotor for a gas turbine, in particular for an axial compressor, said disk rotor comprising a series of disks 20 axially constrained by a series of tie rods and a series of vanes for each disk of the series of disks 20.

Said disk 20 has a central portion 22, an intermediate portion 24 and an outer portion 28.

The outer portion 28 has a substantially truncated-conical shape and is equipped with a base surface 31 and a shaped outer side surface 29.

The outer portion 28 of the disk 20 comprises a series of axial pass-through holes 27, preferably circular, for a respective series of tie rods to form a single set of disks 20.

The series of holes 27 is situated on the base surface 31 of the outer portion 28.

Furthermore, the holes of the series of holes 27 are positioned at an equal distance from each other along a circumference 61 lying on the base surface 31 coaxial with the axis of the disk.

As the series of holes 27 is in the outer portion 28, a disk with high dynamic characteristics is obtained.

Said disk comprises a series of slots 50, which are positioned at an equal distance along the outer side surface 29 of the outer portion 28, for housing a respective series of vanes.

The central portion 22 has a central axial pass-through hole 23 and, at a first end of the central portion 22, a first base collar 30 and, at a second end of the central portion 22, a second base collar 40.

The first base collar 30 and the second base collar 40 are respectively equipped with a male coupling and a female coupling to axially centre the series of disks 20 with a high precision degree.

Said male and female couplings allow at least two disks 20 to be constrained by interference and at the same time allow their accurate centering.

The first base collar 30 is substantially a cylinder having a base surface 32, an outer side surface 34 with a greater diameter and an inner side surface having the same diameter as the hole 23.

The intermediate portion 24 comprises a first base surface 25 and a second base surface 26 connected to the third outer portion 28 by means of joints.

The base surface 32 is preferably connected to the outer side surface 34 by means of a bevel 38, and the outer side surface 34 is also connected to the first base surface 25 of the intermediate portion 24 by means of a relief 36.

The second collar 40 is substantially a cylindrical ring having, in correspondence with the second end of the central portion 22, an enlarged cylindrical section with respect to the central hole 23 acting as a female coupling for a respective male coupling of another disk 20.

The second collar 40 comprises a first internal base surface 42, and internal side surface 44, an outer base surface 45 and an outer side surface 47.

The first internal base surface 42 is preferably connected to the internal side surface 44 by means of a relief 46, and the internal side surface 44 is also connected to the second outer base surface 45 by a bevel 48.

The first internal base surface 42 defines, together with the internal side surface 44, the relief 46 and the bevel 48, the enlarged cylindrical section of the second collar 40.

The internal side surface 44 can be coupled by interference with the respective outer side surface 34 of the portion 30 of another disk 20 so as to also couple, by inserting one disk on another, the base surface 32 of the first collar 30 with the first internal base surface 42 of the second collar 40.

In this way, it is possible to couple all the disks of the series of disks 20, obtaining an axial centering of the series of disks 20 with a high precision degree, maintaining an extremely centre which consequently produces better inertia characteristics with respect to cases in which male/female couplings of this type are not present, and also due to the presence of the bevels 34 and 44 and reliefs 36 and 46.

The outer side surface 47 is connected to the second base surface 26 of the intermediate portion 24 by means of a joint, and is also connected to the second outer base surface 45. As the outer portion 28 is subjected to great stress, it is important to position the series of holes 27 so as not to intensify the mechanical and thermal stress caused by the vanes during the functioning of the turbine.

The disk 20 preferably has a total number of holes of the series of holes 27 equal to the total number of slots of the series of slots 50 for the series of vanes.

Numerous tests and analyses have been effected which have revealed that the relative position of the vanes with respect to the holes, is extremely important.

The holes are axial pass-through holes, i.e. parallel to the axis of the disk 20, whereas the slots are tilted with respect to the axis of the disk itself in two directions, axial and vertical.

A point 80 is defined for each slot which is a reference for centering the relative vane, of the series of vanes, on the disk 20.

Figure 8:
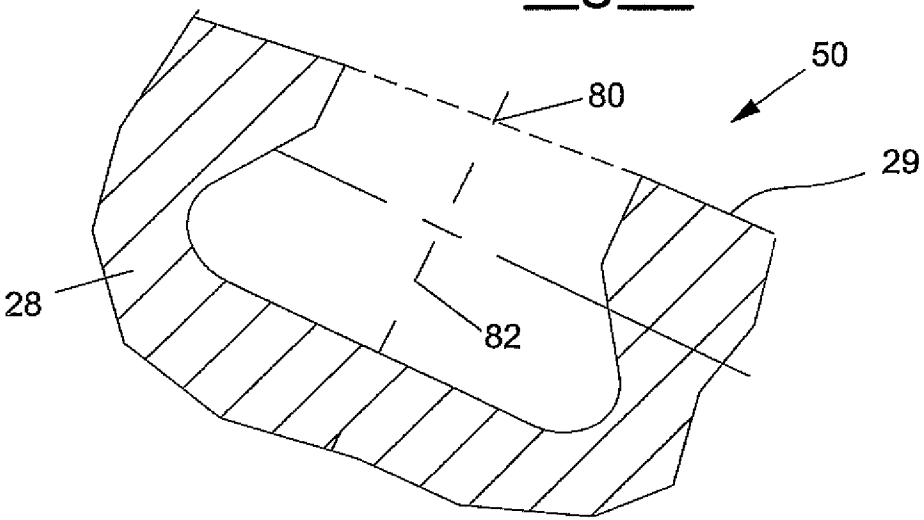
FIG. 8 is a sectional view of FIG. 7 according to the line VIII-VIII.

The point 80 is obtained by the intersection of an axis 82 of the slot of the middle side section of the disk 20, shown in FIG. 8, with the extension of the side surface 29.

Considering FIG. 1, it is possible to observe an angle 83 which indicates the angular reference between the centre of a hole 27 and the position of the point 80 of an adjacent slot.

The angle 83 ranges from 2 to 10, preferably from 4 to 8 sexagesimal degrees.

Figure 7:
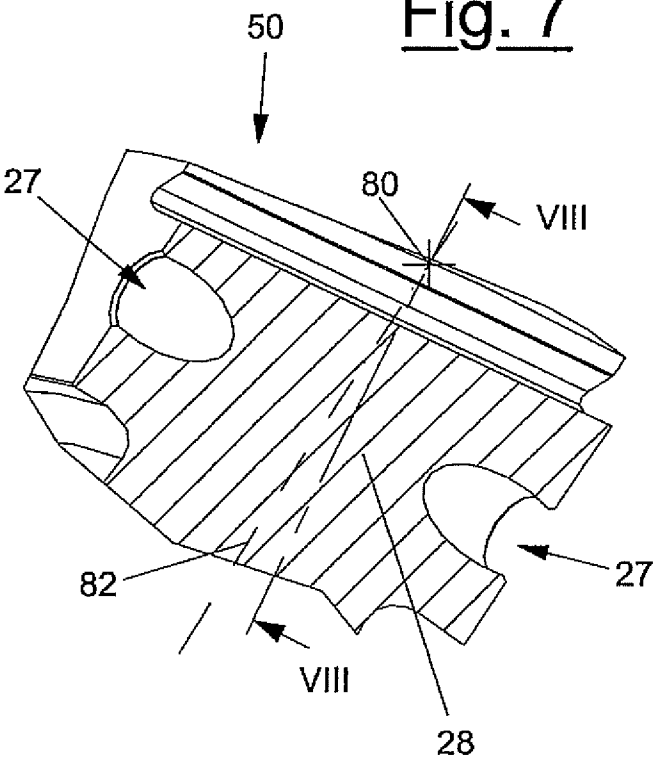
FIG. 7 is a sectional view of FIG. 5 according to the line VII-VII.

With reference to FIG. 7, it can be noted that, by thus positioning the slots with respect to the holes, a sufficiently resistant section is obtained, which allows a good resistance to cyclic stress and consequently a sufficient useful life of the component.

At the same time, having positioned the holes of the series of holes 27 in the outer portion of the disk 20, preferably with the diameter of the circumference 61 close to the diameter of the disk 20, high flexural and torsional inertia characteristics of the rotor 20 are obtained.

It can thus be seen that a disk of a disk rotor for a gas turbine according to the present invention achieves the objectives specified above.

Numerous modifications and variants can be applied to the disk of a disk rotor for a gas turbine of the present invention thus conceived, all included within the inventive concept.

Furthermore, in practice, the materials used, as also their dimensions and components, can vary according to technical demands.

The invention claimed is:

1. A disk of a disk rotor for a gas turbine comprising:

a central portion having a central axis pass-through hole, a first collar situated at a first end and a second collar situated at a second end of the central portion;

an intermediate portion disposed around the central portion;

an outer portion disposed around the intermediate portion, the outer portion having a series of axial pass-through holes configured to receive a series of tie rods and having a series of slots configured to house a corresponding series of vanes, wherein the series of holes is positioned in the outer portion of the disk so as to obtain high dynamic characteristics of the rotor and at the same time a sufficient useful life thereof, and each slot has a reference point for placing a corresponding vane, an angle between the reference point of a slot and a central point of the closest hole of the series of holes is between 2 and 10 sexagesimal degrees, and the reference point is defined by an intersection of (i) a central axis of the slot in a middle side section of the disk with (ii) an extension of a side surface of the outer portion, the axis of the slot being radial from an axial direction of the disk and the central point is defined by a radial line extending from said central axis pass through hole through the center of the closest hole in the middle section of the disk.

2. The disk of a disk rotor for a gas turbine according to claim 1, wherein said series of holes is situated on a base surface of the outer portion.

3. The disk of a disk rotor for a gas turbine according to claim 2, wherein the holes of said series of holes are positioned at an equal distance from each other along a circumference lying on the base surface, said circumference being coaxial with the axial direction of the disk.

4. The disk of a disk rotor for a gas turbine according to claim 1, wherein said first collar comprises a bevel and a relief and said second collar comprises a bevel and a relief.

5. The disk of a disk rotor for a gas turbine according to claim 1, wherein the disk has a total number of holes of the series of holes which is equal to the total number of slots of the series of slots for the series of vanes.

6. The disk of a disk rotor for a gas turbine according to claim 1, wherein said angle ranges from 4 to 8 sexagesimal degrees.

7. The disk of a disk rotor for a gas turbine according to claim 3, wherein the diameter of the circumference is close to the diameter of the disk.

8. A disk rotor for a compressor comprising a series of disks according to claim 1 and also comprising a series of tie rods, and a series of vanes.

9. The disk of a disk rotor for a gas turbine according to claim 1, wherein each slot of the series of the slots is tilted both axially and vertically relative to axial and vertical directions of the disk.

10. The disk of a disk rotor for a gas turbine according to claim 1, further comprising:

the series of vanes, wherein a center of each vane is placed to coincide with the reference point of a corresponding slot.

11. The disk of a disk rotor for a gas turbine according to claim 1, wherein each vane extends along an axis within a corresponding slot that is different from the axial direction.

12. A disk of a disk rotor comprising:

a central portion having a central axis pass-through hole;

an intermediate portion disposed around the central portion;

an outer portion disposed around the intermediate portion, the outer portion having a series of axial pass-through holes and a series of slots in a side surface of the outer portion, wherein each slot has a reference point for placing a corresponding vane, an angle between the reference point of a slot and a central point of the closest hole of the series of holes is between 2 and 10 sexagesimal degrees, and the reference point is defined by an intersection of a central axis of the slot in a middle side section of the disk with an extension of the side surface of the outer portion, the axis of the slot being radial from an axial direction of the disk and the central point is defined by a radial line extending from said central axis pass through hole through the center of the closest hole in the middle section of the disk.

13. The disk of a disk rotor according to claim 12, wherein each slot of the series of the slots is tilted both axially and vertically relative to axial and vertical directions of the disk.

14. The disk of a disk rotor according to claim 12, further comprising:

a series of vanes configured to be attached to the series of slots.

15. The disk of a disk rotor according to claim 14, wherein a center of each vane is placed to coincide with the reference point of each slot.

16. The disk of a disk rotor according to claim 12, wherein the central portion further comprises:

a central axis pass-through hole;

a first collar situated at a first end of the central portion; and a second collar situated at a second end of the central portion.

17. The disk of a disk rotor according to claim 16, wherein a diameter of the first collar is smaller than a diameter of the second collar.

18. The disk of a disk rotor according to claim 16, wherein the first collar fits inside the second collar.

19. The disk of a disk rotor according to claim 12, wherein the disk is part of a gas turbine.

20. The disk of a disk rotor according to claim 12, further comprising:

a series of vanes, wherein each vane extends along an axis within a corresponding slot that is different from the axial direction.

* * * * *